US009051742B1

(12) United States Patent
Burnett

(10) Patent No.: US 9,051,742 B1
(45) Date of Patent: Jun. 9, 2015

(54) CEILING SYSTEM

(71) Applicant: Sauder Woodworking Co., Archbold, OH (US)

(72) Inventor: Marvin K. Burnett, Archbold, OH (US)

(73) Assignee: Sauder Woodworking Co., Archbold, OH (US)

( * ) Notice: Subject to any disclaimer, the term of this patent is extended or adjusted under 35 U.S.C. 154(b) by 0 days.

(21) Appl. No.: 14/529,841

(22) Filed: Oct. 31, 2014

Related U.S. Application Data

(60) Provisional application No. 61/910,448, filed on Dec. 2, 2013.

(51) Int. Cl.

| | |
|---|---|
| ***E04B 2/00*** | (2006.01) |
| ***E04F 13/26*** | (2006.01) |
| ***E04F 13/07*** | (2006.01) |
| ***E04F 13/24*** | (2006.01) |

(52) U.S. Cl.
CPC ..... *E04F 13/26* (2013.01); *E04F 13/07* (2013.01); *E04F 13/24* (2013.01)

(58) Field of Classification Search
CPC ..... E04B 9/00; E04B 9/3064; E04B 9/30; E04B 9/34; E04F 13/26; E04F 13/07; E04F 13/24
USPC ..... 52/506.01
See application file for complete search history.

(56) References Cited

U.S. PATENT DOCUMENTS

| | | | |
|---|---|---|---|
| 2,389,171 | A | 11/1945 | Urbain |
| 3,618,176 | A | 11/1971 | Barnes |
| 3,936,990 | A | 2/1976 | Garrison et al. |
| 3,952,985 | A | 4/1976 | Davenport |
| 4,073,458 | A | 2/1978 | Sease |
| 4,112,550 | A | 9/1978 | DeWitt et al. |
| 4,281,498 | A | 8/1981 | Kern |
| 4,315,611 | A | 2/1982 | Hoop |
| 4,361,996 | A | 12/1982 | Smith |
| 4,452,021 | A | 6/1984 | Anderson |
| 4,454,700 | A | 6/1984 | Kern |
| 4,463,537 | A | 8/1984 | Rodriquez et al. |
| 4,464,876 | A | 8/1984 | Kern |
| 4,546,587 | A | 10/1985 | Mosch |
| 4,674,254 | A | 6/1987 | Koehler et al. |

(Continued)

OTHER PUBLICATIONS

"Plasti-clip Hang-Ups," Plasti-clip Web site, at least as early as Oct. 17, 2008, pp. 1-9, published by Plasti-clip, Milford, NH.

(Continued)

*Primary Examiner* — Mark Wendell
*Assistant Examiner* — Keith Minter
(74) *Attorney, Agent, or Firm* — MacMillan, Sobanski & Todd, LLC

(57) ABSTRACT

A ceiling system including, among other things, a clip adapted for attachment to a ceiling or a wall. The clip has at least one panel engagement surface, at least one molding surface, and at least one molding attachment member positioned adjacent to the at least one molding surface. The system further includes a panel having an interior surface adapted for engagement with a ceiling or a wall and an exterior surface adapted for engagement with the at least one panel engagement surface. The system further includes a molding having a surface adapted for engagement with the at least one molding surface and a slot adapted for engagement with the at least one molding attachment member.

16 Claims, 5 Drawing Sheets

(56) References Cited

U.S. PATENT DOCUMENTS

| | | | |
|---|---|---|---|
| 4,722,161 | A | 2/1988 | Young |
| 4,742,662 | A | 5/1988 | Smith |
| 4,773,200 | A | 9/1988 | Young |
| 4,848,054 | A | 7/1989 | Blitzer et al. |
| 4,926,606 | A | 5/1990 | Hanson |
| 5,082,227 | A | 1/1992 | Insko |
| 5,239,801 | A | 8/1993 | Adams |
| 5,265,393 | A | 11/1993 | Bischel et al. |
| 5,355,646 | A | 10/1994 | Bischel et al. |
| 5,433,048 | A | 7/1995 | Strasser |
| 5,457,925 | A | 10/1995 | Koedyker |
| 5,490,651 | A | 2/1996 | Kump |
| 5,535,566 | A | 7/1996 | Wilson et al. |
| 5,619,833 | A | 4/1997 | Neff |
| 5,836,127 | A | 11/1998 | Clark et al. |
| 5,845,447 | A | 12/1998 | Bodine et al. |
| 5,970,669 | A | 10/1999 | Livingston |
| 5,979,134 | A | 11/1999 | Neff |
| 6,029,413 | A | 2/2000 | Compas, Jr. |
| 6,077,593 | A | 6/2000 | Schlachter |
| 6,092,777 | A | 7/2000 | Kuntz |
| 6,101,777 | A | 8/2000 | Bodine et al. |
| 6,145,264 | A | 11/2000 | Dallaire |
| 6,205,732 | B1 | 3/2001 | Rebman |
| 6,205,733 | B1 | 3/2001 | LaLonde |
| 6,230,463 | B1 | 5/2001 | Bodine |
| D446,110 | S | 8/2001 | McDuff et al. |
| 6,270,915 | B1 | 8/2001 | Turpin et al. |
| 6,295,036 | B1 | 9/2001 | Mata et al. |
| 6,305,137 | B1 | 10/2001 | Rebman |
| 6,305,495 | B1 | 10/2001 | Keegan |
| 6,324,806 | B1 | 12/2001 | Rebman |
| 6,467,228 | B1 | 10/2002 | Wendt et al. |
| 6,536,173 | B2 | 3/2003 | Rebman |
| 6,574,936 | B1 | 6/2003 | Anderson, Sr. |
| 6,892,500 | B2 | 5/2005 | Zaborowski |
| 7,117,650 | B2 | 10/2006 | Dockery |
| 7,478,506 | B2 | 1/2009 | Wendt et al. |
| 8,240,099 | B2 | 8/2012 | Hummel, III |
| 8,347,577 | B2 | 1/2013 | Aboukhalil |
| 8,359,802 | B1 | 1/2013 | Burnett et al. |
| 2007/0283656 | A1 | 12/2007 | Anderson |
| 2008/0276560 | A1 | 11/2008 | Labonte |

OTHER PUBLICATIONS

"Ceiling Accessories," FFR Web site, at least as early as Oct. 20, 2008, pp. 1-5, published by FFR, Twinsburg, OH.

Merle Henkenius, "How to Install a Suspended Ceiling," Popular Mechanics Web site, pp. 1-3, at least as early as Apr. 16, 2010, published by Hearst Communications, Inc., New York, NY.

"ACP Suspended PVC Ceiling Grid," The Home Depot Web site, at least as early as Apr. 16, 2010, pp. 1-2, published by the Home Depot, Inc., Atlanta, GA.

"Grid Ceiling Systems," Colorado Ceilings Web site, pp. 1-2, at least as early as Apr. 16, 2010, published by IDS Group, Denver, CO.

"Chicago Metallic Suspended Ceiling Grid Tee 2'," eBay Web site, pp. 1-2, at least as early as Apr. 16, 2010, published by eBay Inc., San Jose, CA.

Notice of Allowance, U.S. Appl. No. 12/830,488, date mailed Mar. 6, 2013.

Office Action, U.S. Appl. No. 12/830,488, date mailed Aug. 23, 2012.

CEILING SYSTEM

CROSS-REFERENCE TO RELATED APPLICATIONS

This relates to and claims the benefit of U.S. Provisional Patent Application No. 61/910,448, filed on Dec. 2, 2013, which is incorporated herein by reference in its entirety.

TECHNICAL FIELD

The invention relates generally to building products. More specifically, the invention is directed to a ceiling system.

BACKGROUND OF THE INVENTION

There is a need for a ceiling system that is easy and efficient to assemble. The invention provides such as a system.

BRIEF SUMMARY OF THE INVENTION

The invention is a ceiling system including, among other things, a clip adapted for attachment to a ceiling or a wall. The clip has at least one panel engagement surface, at least one molding surface, and at least one molding attachment member positioned adjacent to the at least one molding surface. The system further includes a panel having an interior surface adapted for engagement with a ceiling or a wall and an exterior surface adapted for engagement with the at least one panel engagement surface. The system further includes a molding having a surface adapted for engagement with the at least one molding surface and a slot adapted for engagement with the at least one molding attachment member.

DETAILED DESCRIPTION OF THE INVENTION

Figure 1:
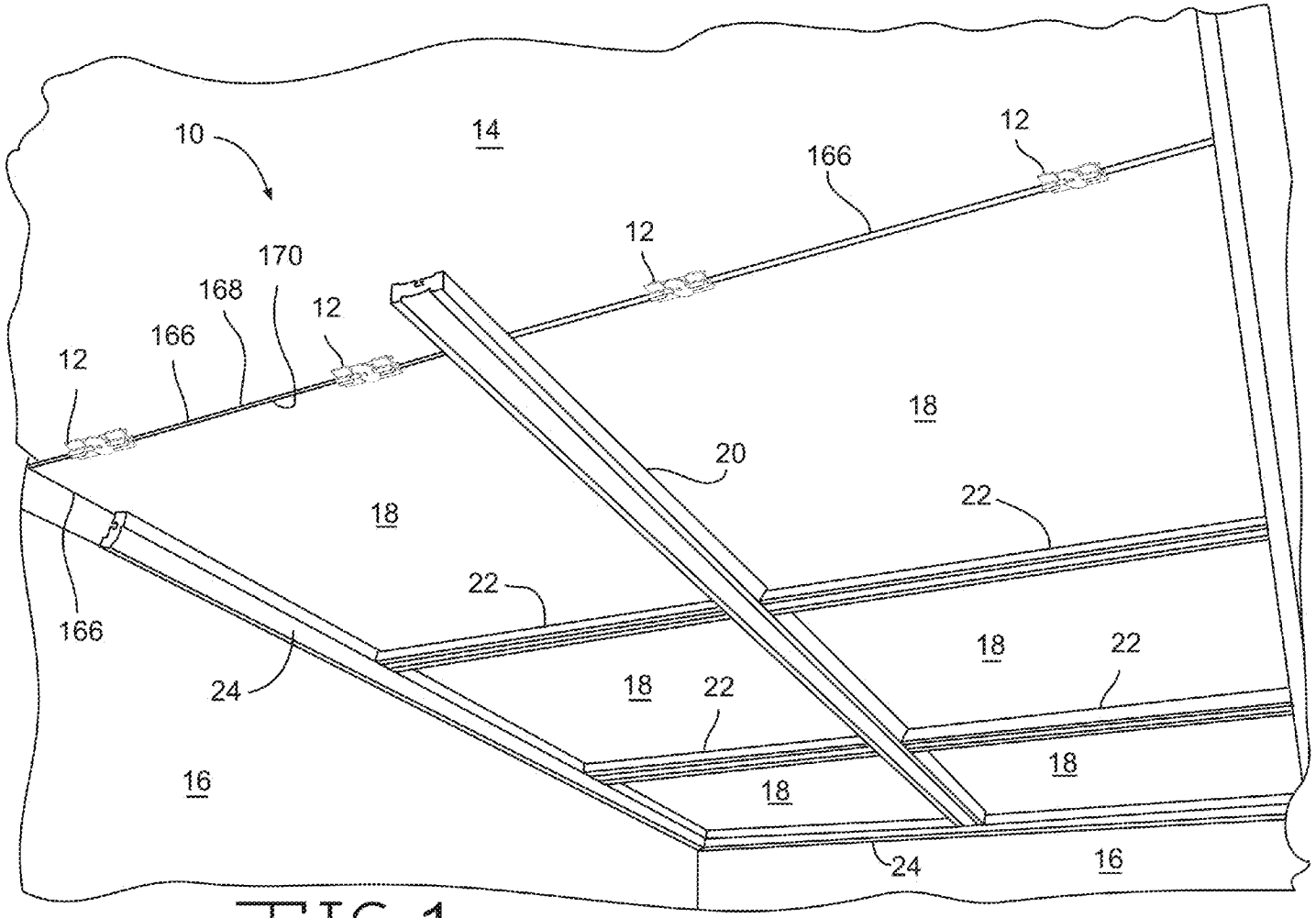
FIG. 1 is a perspective view of an embodiment of a ceiling system according to the invention.

An embodiment of the ceiling system according to the invention will now be described in detail with reference being made to the drawings. In the drawings, the ceiling system is indicated generally by the reference number "10."

Referring to FIG. 1, the ceiling system 10 includes one or more clips 12 that are attached to a ceiling 14 or a wall 16 or both. The clips 12 support one or more panels 18. The clips 12 also support one or more moldings such as main moldings 20, cross moldings 22, and wall moldings 24.

Figure 2:
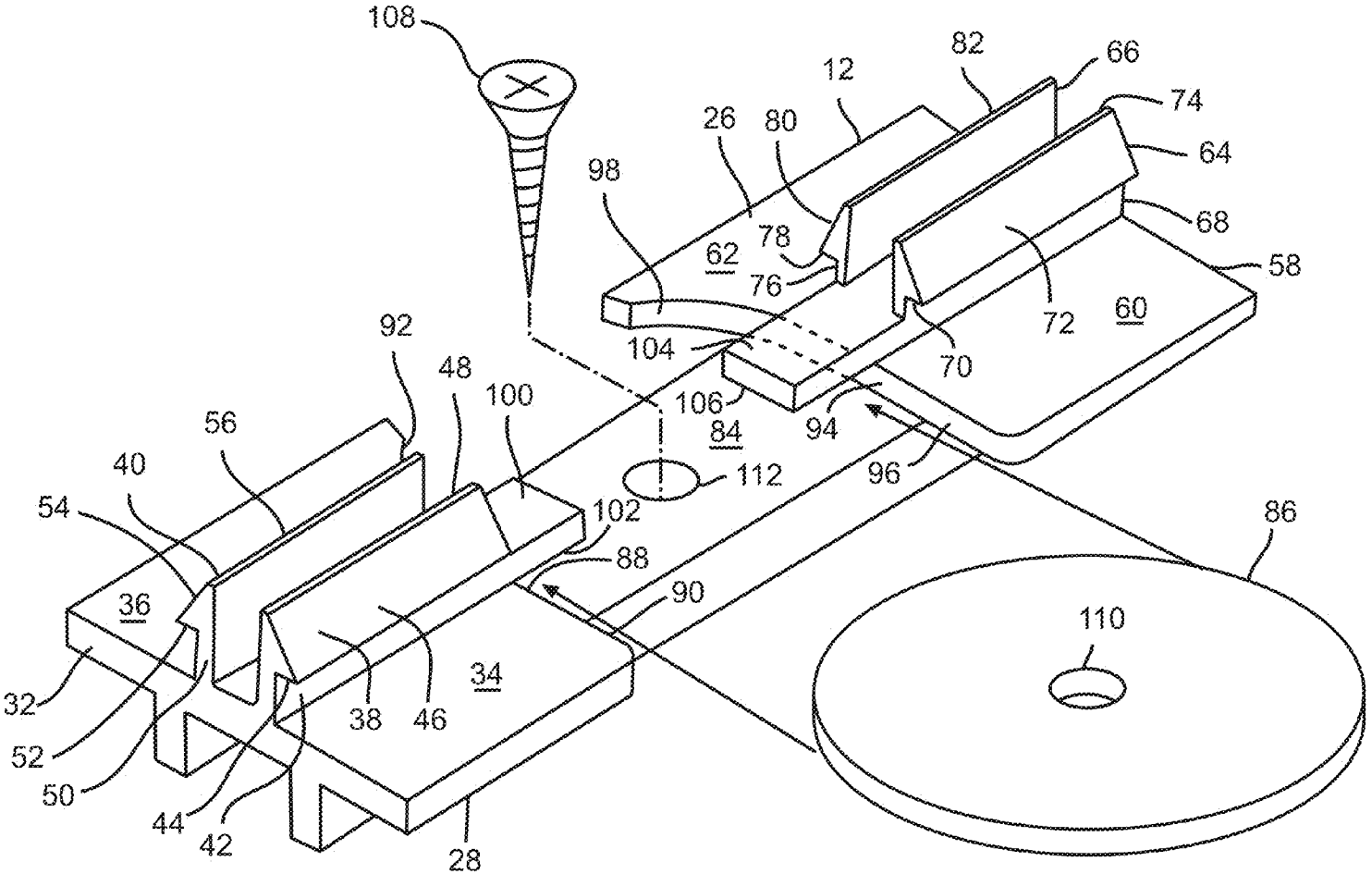
FIG. 2 is a perspective view of an embodiment of a clip according to the invention.
Figure 3:
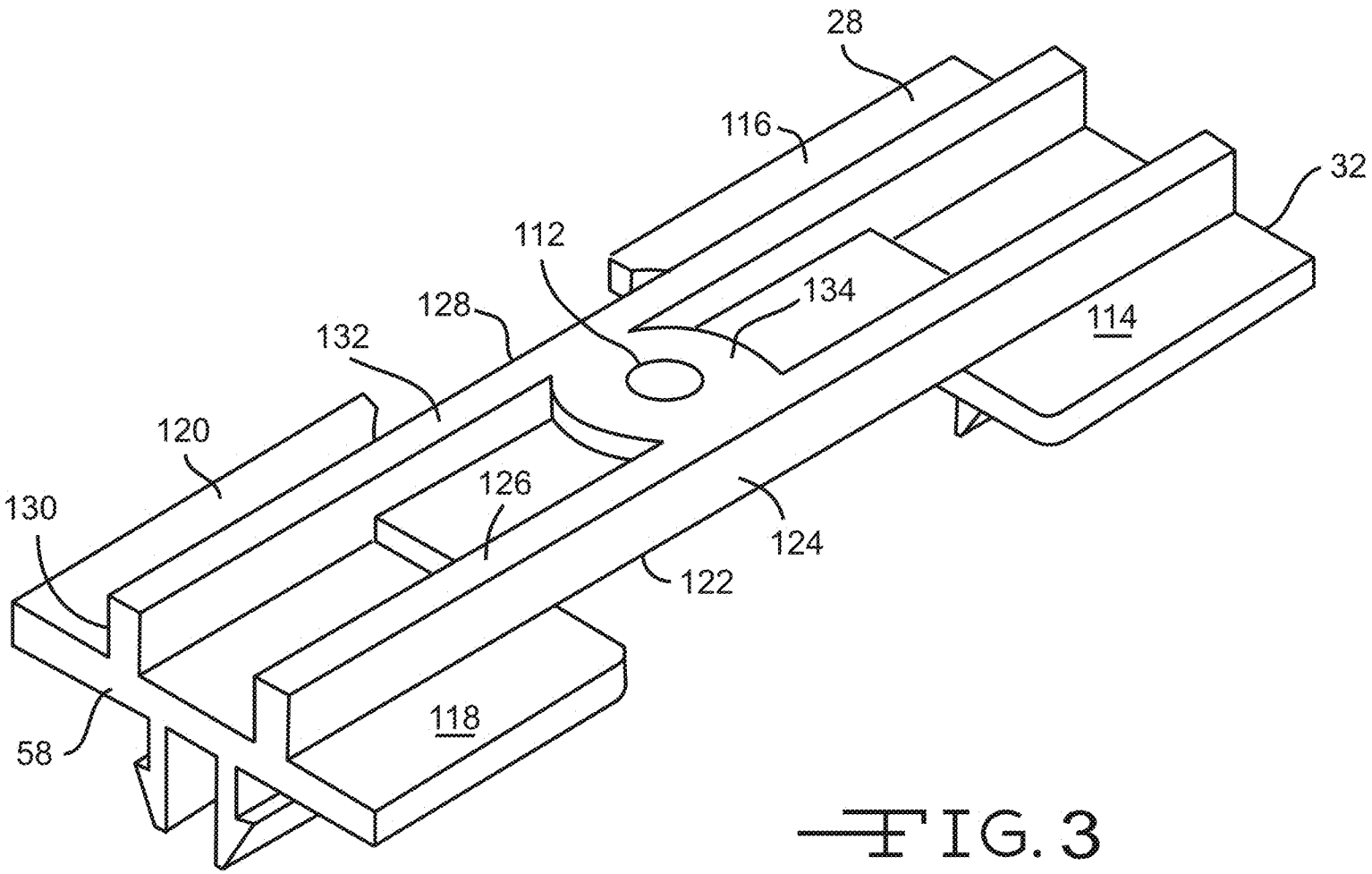
FIG. 3 is a perspective view of an embodiment of a clip according to the invention.

Referring to FIGS. 2 and 3, the clip 12 includes a molding portion 26 and a ceiling portion 28. As shown in FIG. 2, a first end 32 of the clip 12 on the molding portion 26 includes a first molding surface 34 and a second molding surface 36. The surfaces 34 and 36 are flat and on the same plane as one another. The first end 32 further includes a first molding attachment member 38 that is positioned adjacent to the first molding surface 34 and a second molding attachment member 40 that is positioned adjacent to the second molding surface 36. The first and second molding attachment members 38 and 40 extend outwardly from the first end 32 in spaced relationship to one another. Further, the first and second molding attachment members 38 and 40 are flexible so that they can be moved in relation to one another. The first molding attachment member 38 includes a first leg 42, a first molding engagement surface 44, a first chamfered surface 46, and a first point 48. The second molding attachment member 40 includes a second leg 50, a second molding engagement surface 52, a second chamfered surface 54, and a second point 56.

Still referring to FIG. 2, a second end 58 of the clip 12 on the molding portion 28 includes a third molding surface 60 and a fourth molding surface 62. The surfaces 60 and 62 are flat and on the same plane as one another. Further, the surfaces 60 and 62 are on the same plane as the first and second molding surfaces 34 and 36. The second end 58 further includes a third molding attachment member 64 that is positioned adjacent to the third molding surface 60 and a fourth molding attachment member 66 that is positioned adjacent to the fourth molding surface 62. The third and fourth molding attachment members 64 and 66 extend outwardly from the second end 58 in spaced relationship to one another. Further, the third and fourth molding attachment members 64 and 66 are flexible so that they can be moved in relation to one another. The third molding attachment member 64 includes a third leg 68, a third molding engagement surface 70, a third chamfered surface 72, and a third point 74. The fourth molding attachment member 66 includes a fourth leg 76, a fourth molding engagement surface 78, a fourth chamfered surface 80, and a fourth point 82.

Still referring to FIG. 2, the clip 12 has washer surface 84 that is sized and adapted for positioning a washer such as a round washer 86. The first end 32 has a first washer engagement surface 88 that includes a straight portion 90 adjacent to the first molding surface 34 and a curved portion 92 adjacent to the second molding surface 36. The second end 58 has a second washer engagement surface 94 that includes a straight portion 96 adjacent to the third molding surface 60 and a curved portion 98 adjacent to the fourth molding surface 62. The first and second washer engagement surfaces 88 and 94 are sized and adapted for engaging the washer 86 when it is positioned on the washer surface 84. The first end 32 includes a first washer engagement member 100 that is positioned adjacent to and in spaced relationship with the washer surface 84. The first washer engagement member 100 has a first member surface 102 that is sized and adapted for engaging the washer 86 when it is positioned on the washer surface 84. The second end 58 includes a second washer engagement member 104 that is positioned adjacent to and in spaced relationship with the washer surface 84. The second washer engagement member 104 has a second member surface 106 that is sized and adapted for engaging the washer 86 when it is positioned on the washer surface 84.

When the clip 12 is to be installed on the ceiling 14 or the wall 16, the washer 86 is moved in the direction indicated by the arrows in FIG. 2 so that it is positioned on the washer surface 84. In this regard, the washer 86 is engaged by the first and second washer engagement surfaces 88 and 94 and the first and second member surfaces 102 and 106. A fastener such as a threaded screw 108 extends through a washer opening 110 in the washer 86 and a clip opening 112 of the clip 12 to fasten the clip 12 to the ceiling 14 or the wall 16.

Referring now to FIG. 3, the first end 32 of the clip 12 on the ceiling portion 28 includes a first panel surface 114 and a second panel surface 116. The surfaces 114 and 116 are flat and on the same plane as one another. The second end 58 of the clip 12 on the ceiling portion 28 includes a third panel surface 118 and a fourth panel surface 120. The surfaces 118 and 120 are flat and on the same plane as one another. Further, the surfaces 118 and 120 are on the same plane as the first and second panel surfaces 114 and 116.

As shown in FIG. 3, the clip 12 has a first ceiling rail 122 that extends longitudinally between the first and second ends 32 and 58 adjacent to the first and third panel surfaces 114 and 118. The first ceiling rail 122 includes a first panel wall 124 and a first ceiling engagement surface 126. The first panel wall 124 is flat and has a plane that is perpendicular to the plane of the first and third panel surfaces 114 and 118. The first ceiling engagement surface 126 is flat and has a plane that is horizontal to and spaced from the plane of the first and third panel surfaces 114 and 118. The clip 12 has a second ceiling rail 128 that extends longitudinally between the first and second ends 32 and 58 adjacent to the second and fourth panel surfaces 116 and 120. The second ceiling rail 128 includes a second panel wall 130 and a second ceiling engagement surface 132. The second panel wall 130 is flat and has a plane that is perpendicular to the plane of the second and fourth panel surfaces 116 and 120. The second ceiling engagement surface 132 is flat and has a plane that is horizontal to and spaced from the plane of the second and fourth panel surfaces 116 and 120. The clip 12 includes a third ceiling engagement surface 134 adjacent to the clip opening 112. The first, second and third ceiling engagement surfaces 126, 132 and 134 are on the same plane.

Figure 4:
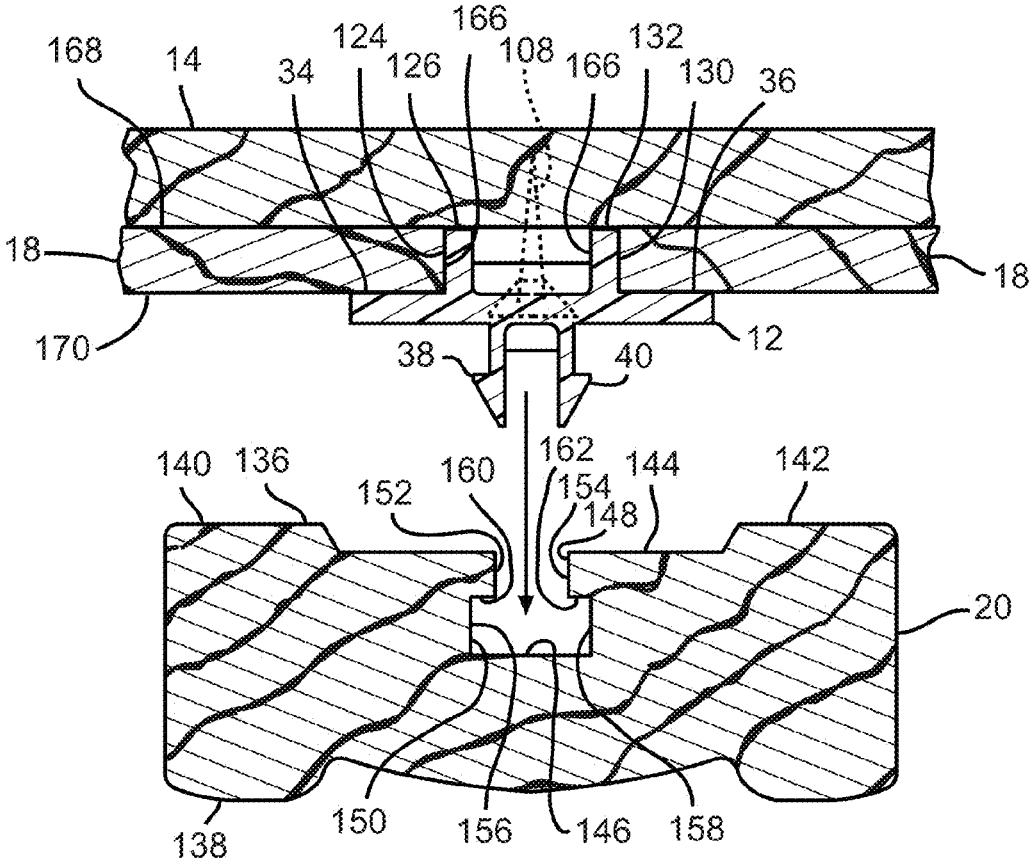
FIG. 4 is a cross-sectional view of an embodiment of a clip according to the invention supporting two panels adjacent to a ceiling as a molding is being attached to the clip.

Referring to FIG. 4, each of the main and cross moldings as represented by main molding 20 includes an interior portion 136 and an exterior portion 138. The interior portion 136 includes a first surface 140 and a second surface 142. A clip recess 144 is positioned between the first and second surfaces 140 and 142. The molding 20 has a slot 146 positioned adjacent to the clip recess 144 that is sized and adapted to correspond to the first, second, third and fourth molding attachment members 38, 40, 64 and 66 of the clip 12. In an embodiment, the slot 146 has a generally T-shaped configuration in which there is a narrow portion 148 and an enlarged portion 150. The narrow portion 148 has first and second narrow portion walls 152 and 154 that are generally parallel to one another. The enlarged portion 150 has first and second enlarged portion walls 156 and 158 that are generally parallel to one another. The enlarged portion 150 also has first and second attachment walls 160 and 162 that are parallel to one another and on the same plane. The first and second attachment walls 160 and 162 are positioned adjacent to and in a generally perpendicular relationship with the first and second narrow portion walls 152 and 154, respectively.

Figure 6:
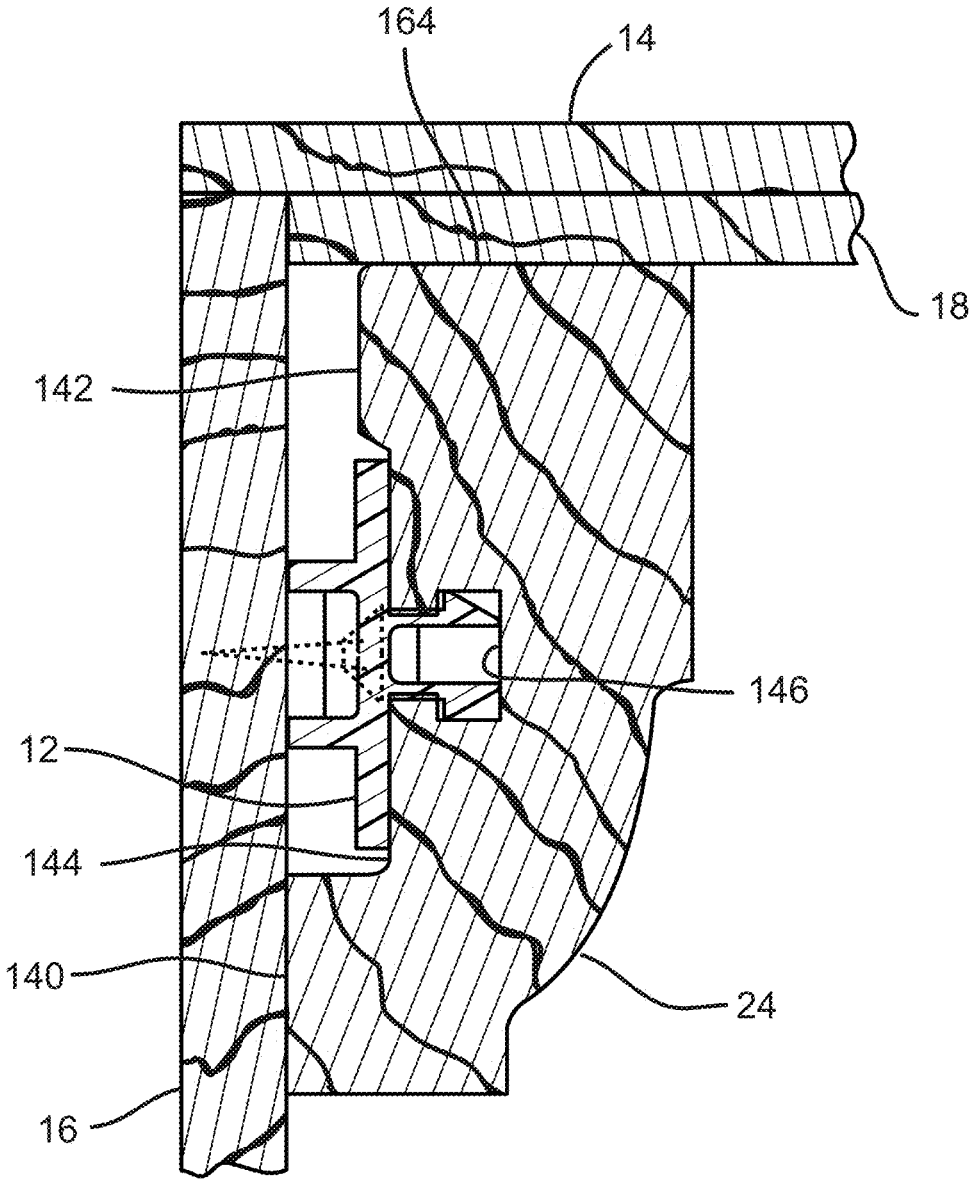
FIG. 6 is a cross-sectional view of an embodiment of a clip according to the invention positioned adjacent to a wall in which a molding has been attached to the clip.

Referring to FIG. 6, each of the wall moldings as represented by wall molding 24 includes the same elements as described above with respect to the main molding 20. In addition, the wall molding 24 includes a third surface 164.

Referring to FIG. 1, each of the panels 18 may have a generally square or a generally rectangular shape defined by four edges 166. Each panel 18 has an interior surface 168 and an exterior surface 170.

Figure 5:
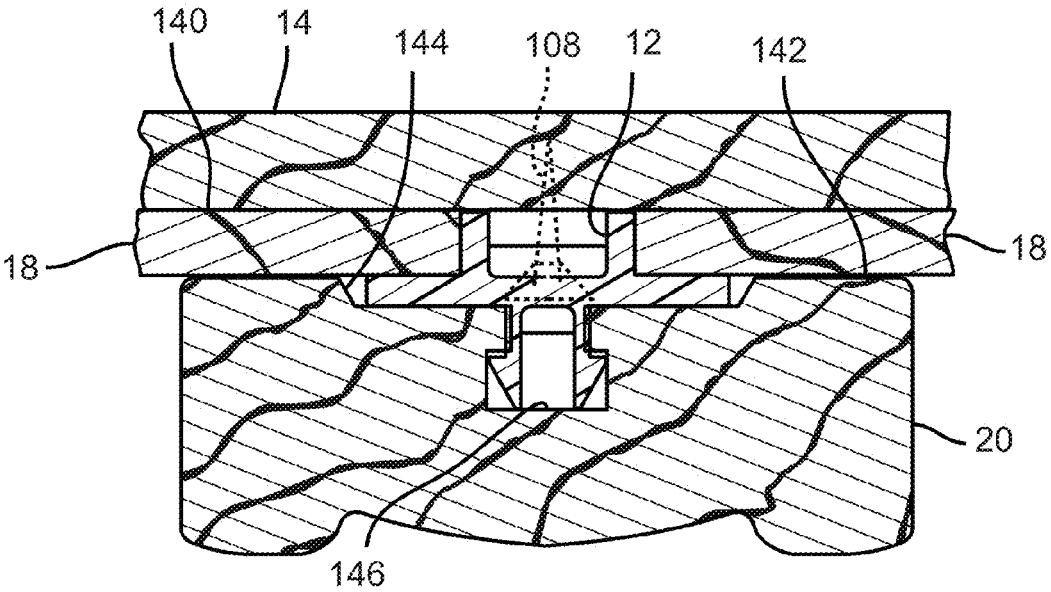
FIG. 5 is a cross-sectional view similar to FIG. 4 in which the molding has been attached to the clip.

Referring to FIGS. 1-6, the ceiling system 10 is installed directly to the ceiling 14 and the walls 16. As shown in FIGS. 2, 4 and 5, the clip 12 is attached to the ceiling 14 by positioning the washer 86 on the washer surface 84 and inserting the screw 108 through the washer and clip openings 110 and 112 and into the ceiling 14. When so positioned, the first, second and third ceiling engagement surfaces 126, 132 and 134 engage the ceiling 14. As shown, two panels 18 are positioned between the clip 12 and the ceiling 14 in which the exterior surfaces 170 of the panels 18 engage the first, second, third and fourth panel surfaces 114, 116, 118 and 120. The edges 166 of the panels 18 engage the first and second panel walls 124 and 130. The interior surfaces 168 of the panels 18 engage the ceiling 14. The clip 12 firmly supports the panels 18 to the ceiling 14.

As shown in FIGS. 2, 4 and 5, each of the main and the cross moldings as represented by the main molding 20 can be snapped onto the clip 12 by inserting the first, second, third and fourth molding attachment members 38, 40, 64 and 66 in the slot 146 as indicated by the arrow in FIG. 4. In this regard, the first, second, third and fourth points 48, 56, 74 and 82 are positioned in the narrow portion 148. As the molding 20 is moved toward the clip 12, the first, second, third and fourth chamfered surfaces 46, 54, 72 and 80 engage the molding 20 to allow the first, second, third and fourth molding attachment members 38, 40, 64 and 66 to flex or move inwardly to allow for passage through the narrow portion 148. The first, second, third and fourth molding engagement surfaces 44, 52, 70 and 78 engage the first and second attachment walls 160 and 162, respectively, upon expansion of the first, second, third and fourth attachment members 38, 40, 64 and 66 in the enlarged portion 150. This allows for the firm attachment of the molding 20 on the clip 12. As shown, the clip 12 is positioned in the clip recess 144 of the molding 20 and the first and second surfaces 140 and 142 are positioned adjacent to the panels 18. The molding 20 may also be slid onto the clip 12.

As shown in FIG. 6, the wall moldings as represented by wall molding 24 may be mounted directly to the wall 16 by the clip 12 in the same manner as described above with respect to the main molding 20. As shown, the first surface 140 is positioned adjacent to the wall 16 and the third surface 164 is positioned adjacent to the panel 18.

Various materials may be used to construct the components of the ceiling system 10. For example, the clip 12 may be constructed of a plastic material such as polypropylene; the washer 86 and the screw 108 may be constructed of metal; and the panels 18 and the moldings 20, 22 and 24 may constructed of a wooden material such as a wood composite material having a paper laminate surface. In addition, the components of the ceiling system 10 may be sold together as a kit or separately for subsequent assembly and installation.

While the invention has been described with reference to particular embodiments, it should be understood that various changes may be made and equivalents may be substituted for elements thereof without departing from the essential scope of the invention. In addition, many modifications may be made to adapt a particular situation or material to the teachings of the invention without departing from the essential scope thereof. Therefore, it is intended that the invention not be limited to the particular embodiments, but that the invention shall include all embodiments falling within the scope of the claims.

What is claimed is:

1. A ceiling system comprising:

a clip having a recessed washer surface including a clip opening, a washer having a washer opening for positioning on the washer surface, and a fastener for insertion through the clip and washer openings for attachment of the clip to a ceiling, the clip having a ceiling portion and an opposed molding portion, the ceiling portion having at least one panel engagement surface, the molding portion having at least one molding surface and at least one molding attachment member positioned adjacent to the at least one molding surface;

a panel having an interior surface for engagement with a ceiling and an exterior surface for engagement with the at least one panel engagement surface; and a molding having a surface for engagement with the at least one molding surface, and a slot for engagement with the at least one molding attachment member.

2. The ceiling system of claim 1, wherein the clip includes first, second, third and fourth panel engagement surfaces being substantially on the same plane as one another.

3. The ceiling system of claim 1, wherein the clip includes first, second, third and fourth molding surfaces being substantially on the same plane as one another.

4. The ceiling system of claim 1, wherein the at least one molding attachment member includes a leg, a molding engagement surface, a chamfered surface, and a point.

5. The ceiling system of claim 1, wherein the clip includes first, second, third and fourth molding attachment members.

6. The ceiling system of claim 5, wherein each of the first, second, third and fourth molding attachment members includes a leg, a molding engagement surface, a chamfered surface, and a point.

7. The ceiling system of claim 1, wherein the at least one molding attachment member is substantially flexible.

8. The ceiling system of claim 1, wherein the clip includes at least one washer engagement surface adjacent to the washer surface.

9. The ceiling system of claim 1, wherein the clip includes opposed first and second washer engagement surfaces adjacent to the washer surface.

10. The ceiling system of claim 9, wherein each of the first and second washer engagement surfaces includes a substantially straight portion and a substantially curved portion.

11. The ceiling system of claim 1, wherein the clip includes at least one ceiling rail including a panel wall and a ceiling engagement surface.

12. The ceiling system of claim 1, wherein the clip includes first and second ceiling rails each including a panel wall and a ceiling engagement surface.

13. The ceiling system of claim 1, wherein the panel has four edges defining a substantially square or rectangular shape.

14. The ceiling system of claim 1, wherein the molding includes a clip recess.

15. The ceiling system of claim 1, wherein the slot includes at least one attachment wall.

16. The ceiling system of claim 1, wherein the slot includes first and second attachment walls being substantially on the same plane as one another.

* * * * *